US010365065B1

(12) United States Patent
Smith

(10) Patent No.: US 10,365,065 B1
(45) Date of Patent: Jul. 30, 2019

(54) GUN SIGHTING ASSEMBLY

(71) Applicant: Benjamin Smith, Aurora, IL (US)

(72) Inventor: Benjamin Smith, Aurora, IL (US)

( * ) Notice: Subject to any disclaimer, the term of this patent is extended or adjusted under 35 U.S.C. 154(b) by 0 days.

(21) Appl. No.: 15/974,685

(22) Filed: May 8, 2018

(51) Int. Cl.

| | |
|---|---|
| ***F41G 1/00*** | (2006.01) |
| ***F41G 1/01*** | (2006.01) |
| ***F41G 1/02*** | (2006.01) |
| ***F41G 1/14*** | (2006.01) |
| ***F41G 1/10*** | (2006.01) |

(52) U.S. Cl.
CPC ..... *F41G 1/01* (2013.01); *F41G 1/02* (2013.01); *F41G 1/10* (2013.01); *F41G 1/14* (2013.01)

(58) Field of Classification Search
CPC ..... F41G 1/00; F41G 1/01; F41G 1/02; F41G 1/10; F41G 1/12; F41G 1/14
USPC ..... 42/111, 133, 140, 141, 144
See application file for complete search history.

(56) References Cited

U.S. PATENT DOCUMENTS

| | | | | |
|---|---|---|---|---|
| 1,363,553 | A | 12/1920 | Barringer | |
| 3,439,970 | A * | 4/1969 | Rickert | F41G 1/02 42/120 |
| 6,058,616 | A | 5/2000 | Bubits | |
| 6,311,424 | B1 * | 11/2001 | Burke | F41G 1/40 42/111 |
| 7,676,137 | B2 * | 3/2010 | Schick | F41G 1/345 33/297 |
| 7,921,591 | B1 * | 4/2011 | Adcock | F41G 1/14 42/113 |
| 8,037,634 | B2 | 10/2011 | Price | |
| D667,525 | S | 9/2012 | Glimpse | |
| 8,479,433 | B1 | 7/2013 | Shebaro | |
| 8,635,801 | B2 | 1/2014 | Glimpse | |
| 8,919,027 | B2 | 12/2014 | Curry | |
| 9,328,993 | B1 * | 5/2016 | Heacock | F41G 1/02 |
| 9,562,743 | B1 | 2/2017 | Mansfield | |
| 2012/0198750 | A1 * | 8/2012 | Mansfield | F41G 1/01 42/132 |

* cited by examiner

*Primary Examiner* — Michael D David

(57) ABSTRACT

A gun sighting assembly for training aiming a gun includes a front sight block that is mountable to a top of a gun. A rear sight block is mounted to the top of the gun. The rear sight block has a pair of alignment slots extending therethrough and each of the alignment slots passes light therethrough. The rear sight block has an elevation slot extending therethrough and the elevation slot passes light therethrough. A plurality of lenses is each coupled to the rear sight block and each of the lenses is aligned with a respective one of the alignment slots and the elevation slot. Each of the lenses is visible to a user when the user properly aims the gun. In this way each of the lenses communicates a visual cue to the user that the user is aiming the gun properly.

9 Claims, 5 Drawing Sheets

GUN SIGHTING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to sighting devices and more particularly pertains to a new sighting device for training aiming a gun.

BRIEF SUMMARY OF THE INVENTION

An embodiment of the disclosure meets the needs presented above by generally comprising a front sight block that is mountable to a top of a gun. A rear sight block is mounted to the top of the gun. The rear sight block has a pair of alignment slots extending therethrough and each of the alignment slots passes light therethrough. The rear sight block has an elevation slot extending therethrough and the elevation slot passes light therethrough. The rear sight block has a channel therein such that front side block is visible through the channel when the gun is being aimed. A plurality of lenses is each coupled to the rear sight block and each of the lenses is aligned with a respective one of the alignment slots and the elevation slot. Each of the lenses is visible to a user when the user properly aims the gun. In this way each of the lenses communicates a visual cue to the user that the user is aiming the gun properly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
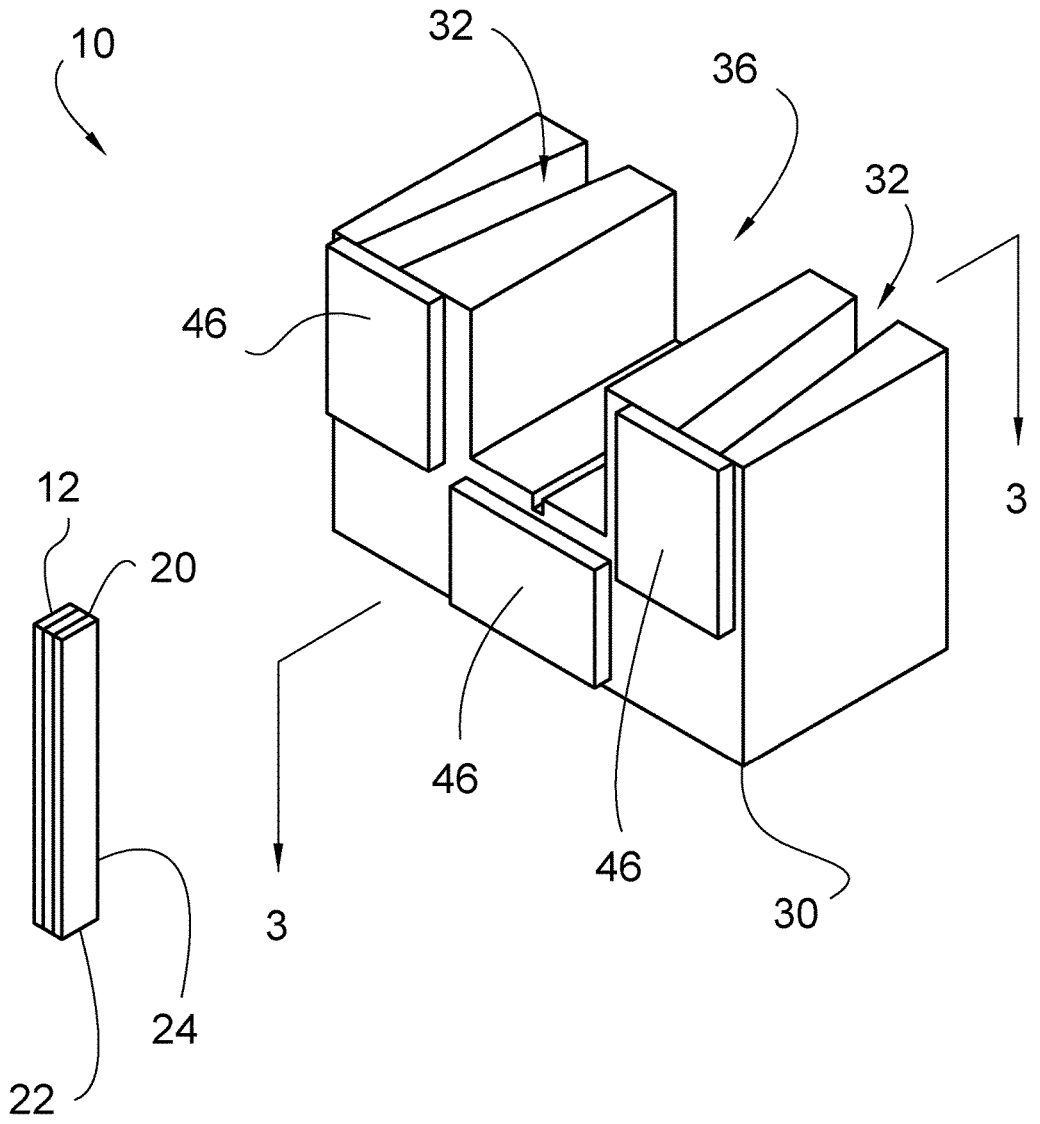
FIG. 1 is a perspective view of a gun sighting assembly according to an embodiment of the disclosure.
Figure 2:
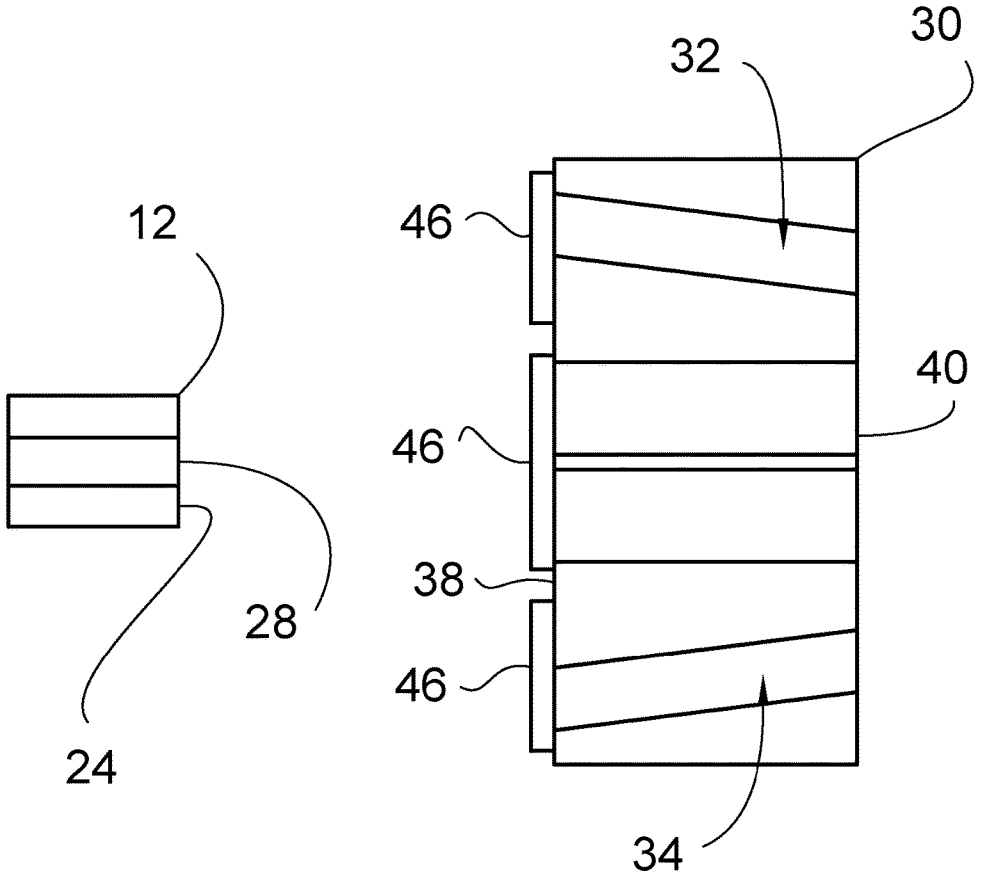
FIG. 2 is a top view of an embodiment of the disclosure.
Figure 3:
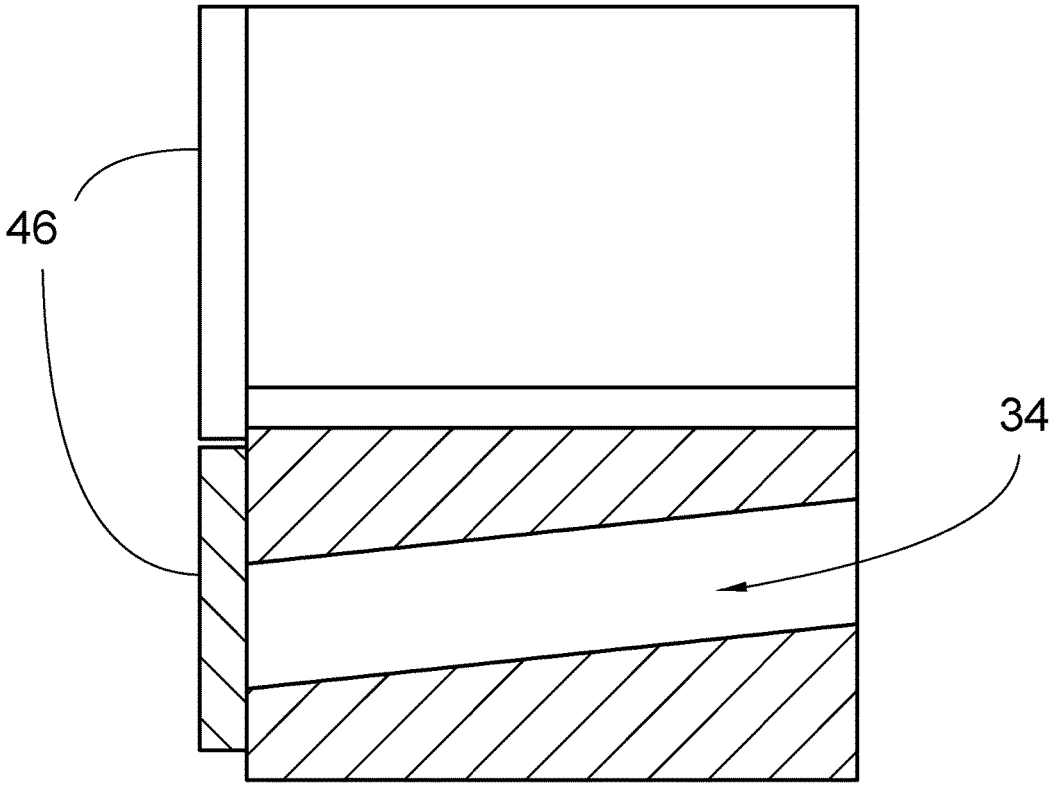
FIG. 3 is a cross sectional view taken along line 3-3 of FIG. 1 of an embodiment of the disclosure.
Figure 4:
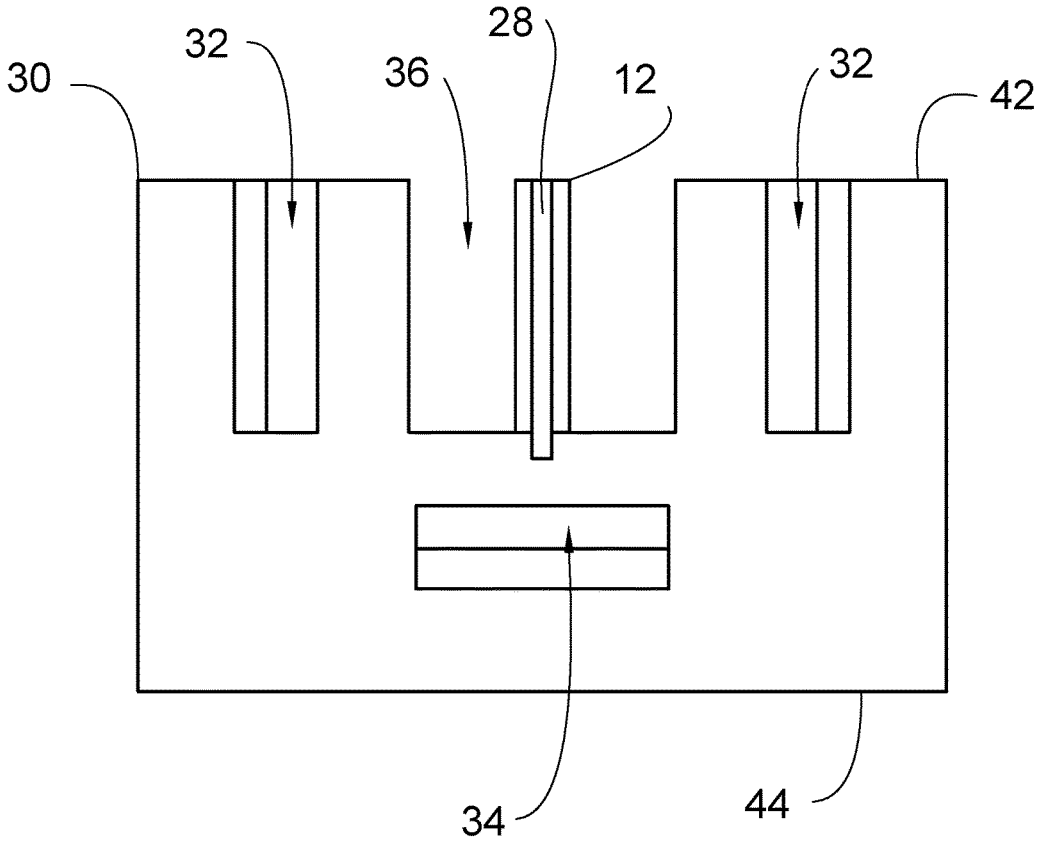
FIG. 4 is a back view of rear sight block of an embodiment of the disclosure.
Figure 5:
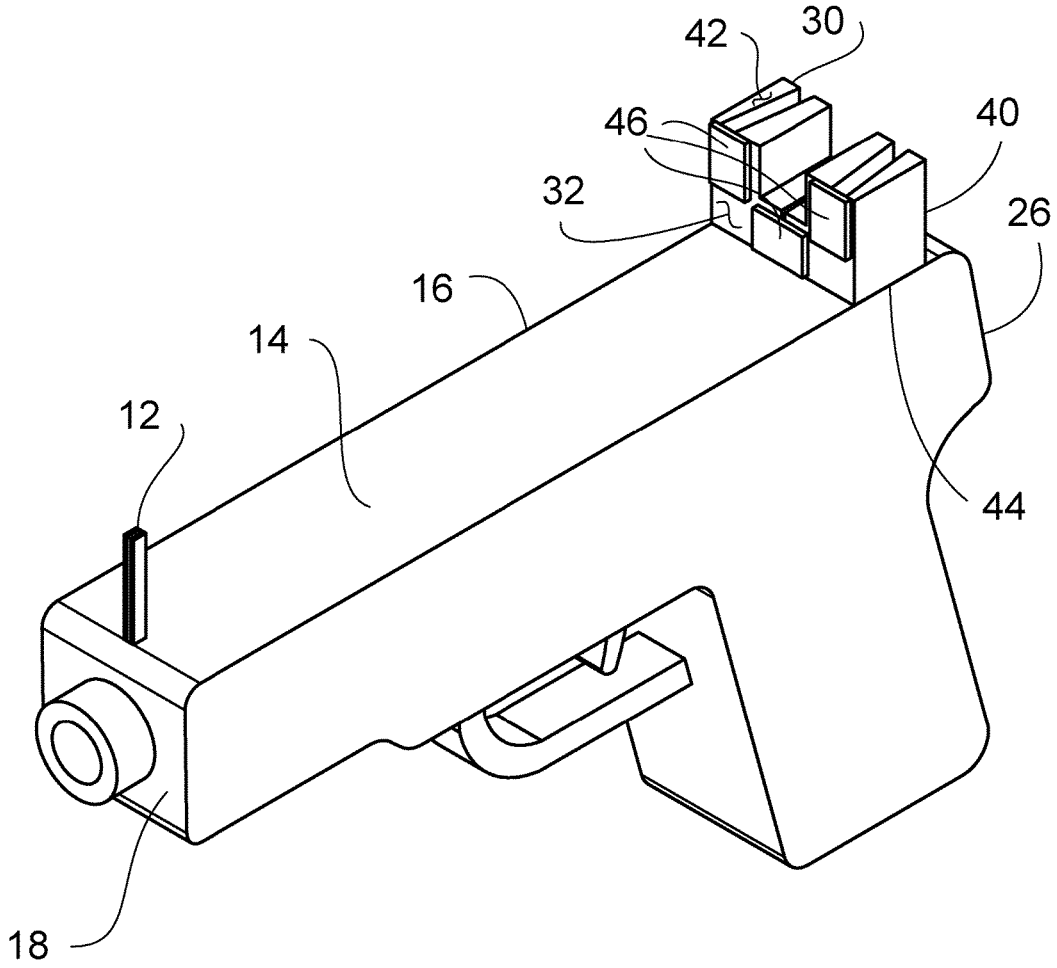
FIG. 5 is a perspective in-use view of an embodiment of the disclosure.

With reference now to the drawings, and in particular to FIGS. 1 through 5 thereof, a new sighting device embodying the principles and concepts of an embodiment of the disclosure and generally designated by the reference numeral 10 will be described.

As best illustrated in FIGS. 1 through 5, the gun sighting assembly 10 generally comprises a front sight block 12 that is mountable to a top 14 of a gun 16. Moreover, the front site block 12 is aligned with a front end 18 of the gun 16. The gun 16 may be a handgun of any conventional design, including semi-automatic handguns and revolvers. The front site block 12 has a top end 20, a bottom end 22 and a rear surface 24 extending therebetween, and the rear surface 24 is directed toward a rear end 26 of the gun 16. A visual cue 28 is coupled to the rear surface 24 of the front sight block 12 and the visual cue 28 extends between the top end 20 and the bottom end 22. The visual cue 28 is centrally positioned on the rear surface 24 and the visual cue 28 may be comprised of a luminescent material.

A rear sight block 30 is provided and the rear sight block 30 is mountable to the top 14 of the gun 16. The rear sight block 30 has a pair of alignment slots 32 extending therethrough and each of the alignment slots 32 passes light through the rear sight block 30. The rear sight block 30 has an elevation slot 34 extending therethrough and the elevation slot 34 passes light through the rear sight block 30. The rear sight block 30 has a channel 36 therein such that front sight block 12 is visible through the channel 36 when the gun 16 is being aimed.

The rear sight block 30 has a front surface 38, a back surface 40, a top surface 42 and a bottom surface 44. The bottom surface 44 is attached to the top 14 of the gun 16 and the channel 36 extends downwardly in the top surface 42 toward the bottom surface 44. The channel 36 extends through the front surface 38 and the back surface 40, and the channel 36 is centrally positioned on the front surface 38 and the back surface 40. Each of the alignment slots 32 extending through the front surface 38 and the back surface 40 and the channel 36 is positioned between each of the alignment slots 32. Moreover, each of the alignment slots 32 angles toward the channel 36 between the front surface 38 and the back surface 40. The elevation slot 34 extends through the front surface 38 and the back surface 40. Additionally, the elevation slot 34 is positioned between the channel 36 and the bottom surface 44 of the rear sight block 30. The elevation slot 34 angles upwardly between the front surface 38 and the rear surface 24 of the rear sight block 30.

A plurality of lenses 46 is provided and each of the lenses 46 is coupled to the rear sight block 30. Each of the lenses 46 is aligned with a respective one of the alignment slots 32 and the elevation slot 34. Moreover, each of the lenses 46 is comprised of a translucent material to pass light therethrough and into the associated alignment 32 and elevation 34 slots. Each of the lenses 46 is visible to a user when the user properly aims the gun 16. In this way each of the lenses 46 communicates a visual cue to the user that the user is aiming the gun 16 properly. Additionally, each of the lenses 46 may have a red color thereby facilitating light passing through the lenses 46 to be clearly visible to the user when the gun 16 is properly aimed. Alternatively, each of the lenses 46 may be comprised of a luminescent material Each of the lenses 46 that are aligned with the alignment slots 32 is visible to the user when the user has the gun 16 aimed in a straight line with respect to the user's line of sight. Moreover, neither of lenses 46 that are aligned with the alignment slots 32 will be visible to the user when the gun 16 is deflected to the left or to the right of the user's line of sight. Thus, each of the lenses 46 aligned with the alignment slots 32 enhance to user's ability to aim the gun 16 in a straight line. The lens 46 that is aligned with the elevation slot 34 is visible to the user when the user has the gun 16 oriented level with respect to the user's line of sight. Additionally, the lens 46 aligned with the elevation slot 34 will not be visible to the user when the user has the gun 16 deflected from the level orientation. In this way the lens 46 aligned with the elevation slot 34 enhances the user's ability to aim the gun 16 in a level orientation.

In use, the user holds the gun 16 during target practice and any other time when the gun 16 may be fired. The user points the gun 16 such that both lenses 46 that are aligned with the alignment slots 32 are visible to the user. In this way the gun 16 is oriented in such a way that the front site block 12 will be centrally aligned in the channel 36 in the rear sight block 30. Thus, the alignment slots 32 eliminate guess work with respect to centering the front site block 12 in the rear sight block 30. The user points the gun 16 such that the lens 46 that is aligned with the elevation slot 34 is visible to the user. In this way the gun 16 is oriented such that the top end 20 of the front site block 12 is aligned with the top surface 42 of the rear sight block 30 when the user looks through the channel 36. Thus, the elevation slot 34 eliminates guess work with respect to aligning the top end 20 of the front site block 12 with the top surface 42 of the rear sight block 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gun sighting assembly configured to train proper aiming of a gun, said assembly comprising:

a front sight block mounted to a top of the gun, said front sight block aligned with a front end of the gun;

a rear sight block mounted to the top of the gun, said rear sight block having a pair of alignment slots extending therethrough wherein each of said alignment slots is configured to pass light therethrough, said rear sight block having an elevation slot extending therethrough wherein said elevation slot is configured to pass light therethrough, said rear sight block having a channel therein such that the front sight block is visible through said channel when said gun is aimed; and a plurality of lenses, each of said lenses coupled to said rear sight block, each of said lenses aligned with an associated one of said alignment slots and said elevation slot, each of said lenses comprised of a translucent material wherein each of said lenses is configured to pass light therethrough and into said associated alignment and elevation slots, each of said lenses visible to a user when the user properly aims the gun wherein each of said lenses is configured to communicate a visual cue to the user that the user is aiming the gun properly.

2. The assembly according to claim 1, wherein said front sight block has a top end, a bottom end and a rear surface extending therebetween, said rear surface directed toward a rear end of the gun.

3. The assembly according to claim 2, further comprising a visual cue coupled to said rear surface of said front sight block, said visual cue extending between said top end and said bottom end, said visual cue centrally positioned on said rear surface.

4. The assembly according to claim 1, wherein said rear sight block has a front surface, a back surface, a top surface and a bottom surface, said bottom surface attached to the top of the gun, said channel extending downwardly in said top surface toward said bottom surface, said channel extending through said front surface and said back surface, said channel centrally positioned on said front surface and said back surface.

5. The assembly according to claim 4, wherein each of said alignment slots extends through said front surface and said back surface, said channel positioned between each of said alignment slots, each of said alignment slots angling toward said channel between said front surface and said back surface.

6. The assembly according to claim 4, wherein said elevation slot extends through said front surface and said back surface, said elevation slot positioned between said channel and said bottom surface of said rear sight block.

7. The assembly according to claim 1, wherein each of said lenses that are aligned with said alignment slots are visible to a user when the user has the gun aimed in a straight line with respect to the user's line of sight wherein each of said lenses aligned with said alignment slots are configured to enhance to user's ability to aim the gun in a straight line.

8. The assembly according to claim 1, wherein said lens that is aligned with said elevation slot visible to the user when the user has the gun oriented level with respect to the user's line of sight wherein said lens aligned with said elevation slot is configured to enhance to user's ability to aim the gun in a level orientation.

9. A gun sighting assembly configured to train proper aiming of a gun, said assembly comprising:

a front sight block mounted to a top of the gun, said front sight block aligned with a front end of the gun, said front sight block having a top end, a bottom end and a rear surface extending therebetween, said rear surface directed toward a rear end of the gun; a visual cue coupled to said rear surface of said front sight block, said visual cue extending between said top end and said bottom end, said visual cue centrally positioned on said rear surface; a rear sight block mounted to the top of the gun, said rear sight block having a pair of alignment slots extending therethrough wherein each of said alignment slots is configured to pass light therethrough, said rear sight block having an elevation slot extending therethrough wherein said elevation slot is configured to pass light therethrough, said rear sight block having a channel therein such that the front sight block is visible through said channel when said gun is aimed, said rear sight block having a front surface, a back surface, a top surface and a bottom surface, said bottom surface attached to the top of the gun, said channel extending downwardly in said top surface toward said bottom surface, said channel extending through said front surface and said back surface, said channel centrally positioned on said front surface and said back surface, each of said alignment slots extending through said front surface and said back surface, said channel positioned between each of said alignment slots, each of said alignment slots angling toward said channel between said front surface and said back surface, said elevation slot extending through said front surface and said back surface, said elevation slot positioned between said channel and said bottom surface of said rear sight block; and a plurality of lenses, each of said lenses coupled to said rear sight block, each of said lenses aligned with an associated one of said alignment slots and said elevation slot, each of said lenses comprised of a translucent material wherein each of said lenses is configured to pass light therethrough and into said associated alignment and elevation slots, each of said lenses visible to a user when the user properly aims the gun wherein each of said lenses is configured to communicate a visual cue to the user that the user is aiming the gun properly, each of said lenses that are aligned with said alignment slots visible to a user when the user has the gun aimed in a straight line with respect to the user's line of sight wherein each of said lenses aligned with said alignment slots are configured to enhance to user's ability to aim the gun in a straight line, said lens that is aligned with said elevation slot visible to the user when the user has the gun oriented level with respect to the user's line of sight wherein said lens aligned with said elevation slot is configured to enhance to user's ability to aim the gun in a level orientation.

* * * * *